US009240641B2

(12) United States Patent
Mukunoki et al.

(10) Patent No.: US 9,240,641 B2
(45) Date of Patent: Jan. 19, 2016

(54) ELECTRIC CONNECTOR AND FIXER USED THEREFOR

(71) Applicant: DAI-ICHI SEIKO CO., LTD., Kyoto (JP)

(72) Inventors: Jun Mukunoki, Shizuoka (JP); Daisuke Matsushita, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/540,914

(22) Filed: Nov. 13, 2014

(65) Prior Publication Data

US 2015/0140869 A1 May 21, 2015

(30) Foreign Application Priority Data

Nov. 19, 2013 (JP) ..... 2013-239192

(51) Int. Cl.
*H01R 12/00* (2006.01)
*H01R 12/70* (2011.01)
*H01R 12/57* (2011.01)

(52) U.S. Cl.
CPC ..... *H01R 12/707* (2013.01); *H01R 12/57* (2013.01); *H01R 12/7029* (2013.01)

(58) Field of Classification Search
USPC ..... 439/79, 545, 547, 554, 563, 566, 570
See application file for complete search history.

(56) References Cited

U.S. PATENT DOCUMENTS

| | | | | | |
|---|---|---|---|---|---|
| 4,826,442 | A * | 5/1989 | Douty et al. | 439/92 |
| 5,562,496 | A * | 10/1996 | Benjamin et al. | 439/607.36 |
| 5,839,916 | A * | 11/1998 | Chishima | 439/495 |
| 7,806,702 | B2 * | 10/2010 | Aihara et al. | 439/79 |
| 7,850,486 | B2 * | 12/2010 | Zhu | 439/570 |
| 7,985,080 | B2 * | 7/2011 | Ai | 439/79 |
| 7,988,496 | B2 * | 8/2011 | Zhu | 439/660 |

FOREIGN PATENT DOCUMENTS

| | | | |
|---|---|---|---|
| JP | H07106028 | 4/1995 | H01R 23/68 |
| JP | H07326439 | 12/1995 | H01R 23/68 |
| JP | 2007073304 | 3/2007 | H01R 12/71 |

* cited by examiner

*Primary Examiner* — Tho D Ta
(74) *Attorney, Agent, or Firm* — Hayes Soloway P.C.

(57) ABSTRACT

An electric connector to be mounted on a printed circuit board, includes a housing having an inner space into which a second electric connector is inserted in a direction in which a plane of the printed circuit board is extensive, and at least one fixer through which the housing is fixed on the printed circuit board, the fixer including an extending portion extending from a floor portion of the housing towards outside of the housing, and making contact at a lower surface thereof with a surface of the printed circuit board, the extending portion being fixed at a lower surface thereof on the surface of the printed circuit board to cause the electric connector to be fixed on the surface of the printed circuit board.

14 Claims, 10 Drawing Sheets

ELECTRIC CONNECTOR AND FIXER USED THEREFOR

BACKGROUND OF THE INVENTION

1. Field of the Invention

The invention relates to an electric connector to be mounted on a printed circuit board, and further to a fixer through which an electric connector is fixed on a printed circuit board.

2. Description of the Related Art

FIG. 14 is a perspective view of the electric connector mounted on a printed circuit board, suggested in Japanese Patent Application Publication No. 2007-73304, and FIG. 15 is a cross-sectional view of the electric connector.

The electric connector 1000 illustrated in FIGS. 14 and 15 includes an electrically insulative housing 1001, and a metal fixer 1002 through which the housing 1001 is fixedly soldered on a printed circuit board 1100. The metal fixer 1002 includes a first portion 1003 soldered onto the printed circuit board 1100, a second portion 1004 having a U-shaped cross-section, and a pair of walls 1005 standing at opposite side edges of the second portion 1004, and a third portion 1006 being continuous to the walls 1005, on which the housing 1001 is fixed.

In the electric connector 1000, the second portion 1004 forwardly extends from the first portion 1003, upwardly U-turns by 180 degrees, and rearwardly extends. The first portion 1003 lies below and in parallel with a bottom 1007 of the housing 1001.

Thus, since the first portion 1003 lies below the bottom 1007 of the housing 1001, the housing 1001 cannot avoid being situated higher to a degree of a thickness of the first portion 1003.

An electric connector is generally required to occupy a small area relative to a printed circuit board, and to be as possibly as low, maintaining a high density with which electric connectors are mounted on a printed circuit board.

SUMMARY OF THE INVENTION

In view of the above-mentioned problem in the conventional electric connector, it is an object of the present invention to provide an electric connector capable of having a reduced height, maintaining a high density with which electric connectors are mounted on a printed circuit board.

It is further an object of the present invention to provide a fixer through which an electric connector is fixed on a printed circuit board, and which is capable of reducing a height of the electric connector, maintaining a high density with which electric connectors are mounted on a printed circuit board.

In one aspect of the present invention, there is provided an electric connector to be mounted on a printed circuit board, including a housing having an inner space into which a second electric connector is inserted in a direction in which a plane of the printed circuit board is extensive, and at least one fixer through which the housing is fixed on the printed circuit board, the fixer including an extending portion extending from a floor portion of the housing towards outside of the housing, and making contact at a lower surface thereof with a surface of the printed circuit board, the extending portion being fixed at a lower surface thereof on the surface of the printed circuit board to cause the electric connector to be fixed on the surface of the printed circuit board.

The electric connector is mounted on a printed circuit board with a floor portion of the housing lying on the printed circuit board, and the extending portion of the fixer extends from the floor portion towards outside of the housing. That is, it is possible to have spaces adjacent to opposite sides of the electric connector. Accordingly, other electric parts can be mounted on a printed circuit board in contiguity with the electric connector. Furthermore, since the extending portion of the fixer is not fixed to a printed circuit board below the housing, it is possible to avoid the housing from being high by a thickness of the extending portion.

It is preferable that the floor portion is formed with a slot being open towards an opening edge of the inner space, the fixer being inserted into the slot to thereby be held relative to the housing.

The fixer can be attached to the housing simply by inserting the fixer into the slot.

It is preferable that the floor portion is raised in a particular area than other area, the particular area including an area in which the slot is formed.

By designing the housing to have the particular area, it is possible to use the particular area as a key for preventing a wrong second electric connector from being inserted into the inner space, or preventing a correct second electric connector from being inserted into the inner space upside down.

It is preferable that the slot is located away from the opening edge, the floor portion having a thickness by which the slot is not covered therewith in an area between the opening edge and the slot.

Since a thickness of the floor portion is reduced between the opening edge and the slot, the extending portion of the fixer can be designed to start at a location closer to a printed circuit board, ensuring that a total length of the fixer can be shortened.

It is preferable that the floor portion is formed with a cut-out starting from the opening edge and terminating at the slot at the longest, the extending portion extending towards outside of the housing through the cut-out.

Since the extending portion of the fixer outwardly extends through the cut-out, it is possible for the extending portion to straightly extend to a printed circuit board, ensuring that a total length of the fixer can be shortened.

It is preferable that the extending portion has a portion downwardly inclining from the floor portion to the printed circuit board.

It is possible to design the extending portion to have resiliency. Thus, when the fixer is bent in accordance with a height between the floor portion of the housing and a printed circuit board, even if the fixer is bent by an angle different from a designed angle, the downwardly inclining portion of the extending portion can absorb the angular gap by resiliently deforming the extending portion to thereby cause the extending portion to be fixed to a printed circuit board. Furthermore, in the case that the floor portion is formed the above-mentioned cut-out, since the downwardly inclining portion can extend through the cut-out, it is possible to have a sufficient area through which the fixer is fixed to a printed circuit board, even if the extending portion is designed short.

It is preferable that the housing is formed at a ceiling portion thereof with at least one of cut-out and a through-hole starting from the opening edge.

By designing the housing to be formed at a ceiling portion thereof with a cut-out or a through-hole, it is possible to observe the fixation of the fixer to a printed circuit board from above the housing.

In another aspect of the present invention, there is provided a fixer through which an electric connector is fixed on a printed circuit board, the electric connector including a housing having an inner space into which a second electric connector is inserted in a direction in which a plane of the printed circuit board is extensive, the housing is formed at a floor portion thereof with a slot being open towards an opening edge of the inner space, the fixer including a first portion to be inserted into the slot and engaged with the slot, a second portion being continuous to the first portion, and having a width greater than a width of the slot for stopping the fixer from being inserted into the slot therebeyond, a third portion being continuous to the second portion, downwardly inclining relative to the first portion, and extending outwardly of the housing when the first portion is inserted into the slot, and a fourth portion being continuous to the third portion, and making contact at a lower surface thereof with a surface of the printed circuit board.

It is preferable that the fixer is made of a single metal plate.

The advantages obtained by the aforementioned present invention will be described hereinbelow.

By using the electric connector in accordance with the present invention, it is possible to arrange other electric parts on a printed circuit board in contiguity with the electric connector, and further, the fixer is fixed to a printed circuit board in an area other than an area where the housing lies on a printed circuit board, ensuring that the housing is avoided from having an increased height. Thus, the electric connector in accordance with the present invention ensures a high density with which electric parts are mounted on a printed circuit board, and a lowered height of an electric connector.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
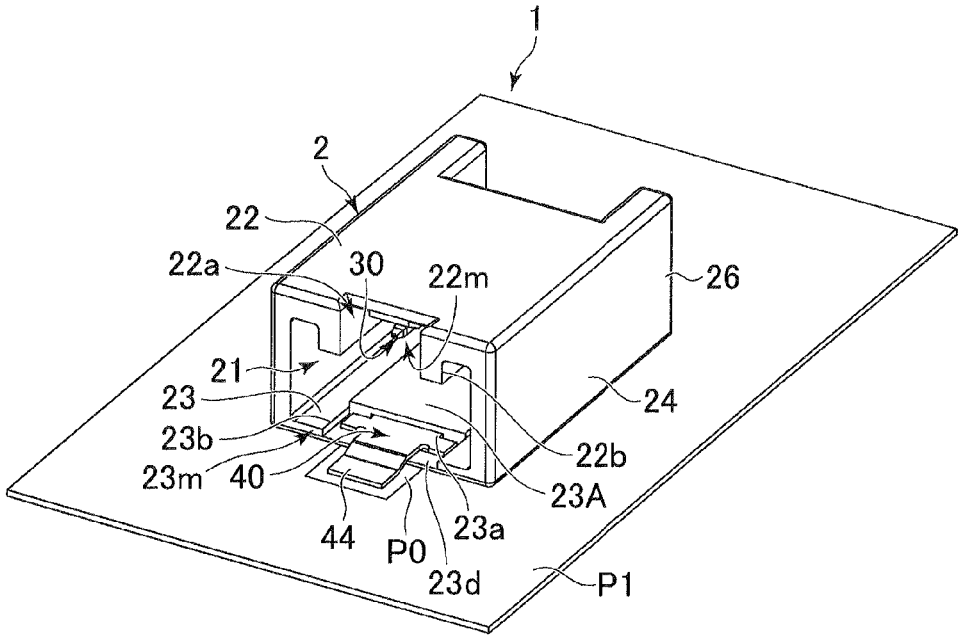
FIG. 1 is a perspective view of the electric connector in accordance with the first embodiment of the present invention.

The electric connector in accordance with the first embodiment of the present invention is explained hereinbelow with reference to the drawings. In the specification, a "front" means a side through which two electric connectors are connected to each other, and a "rear" means the opposite side. An "up" or "upper" means a direction from a printed circuit board toward the electric connector to be mounted on the printed circuit board, and a "down" or "lower" means the opposite direction.

As illustrated in FIGS. 1 to 4, the electric connector 1 in accordance with the first embodiment is mounted on a printed circuit board P1, and is to be connected with a second electric connector (not illustrated).

The electric connector 1 includes a housing 2, connector terminals 30, and a fixer 40.

The housing 2 is defined with a ceiling portion 22, a floor portion 23, a pair of side wall portions 24, and a rear wall 25 to have an inner space 21 therein into which a second electric connector (not illustrated) is inserted in a direction in which a plane of the printed circuit board P1 is extensive. That is, the housing 2 is open at a front thereof. The housing 2 is mounted on the printed circuit board P1 such that a lower surface 23*s* of the floor portion 23 makes contact with the printed circuit board P1.

Figure 3:
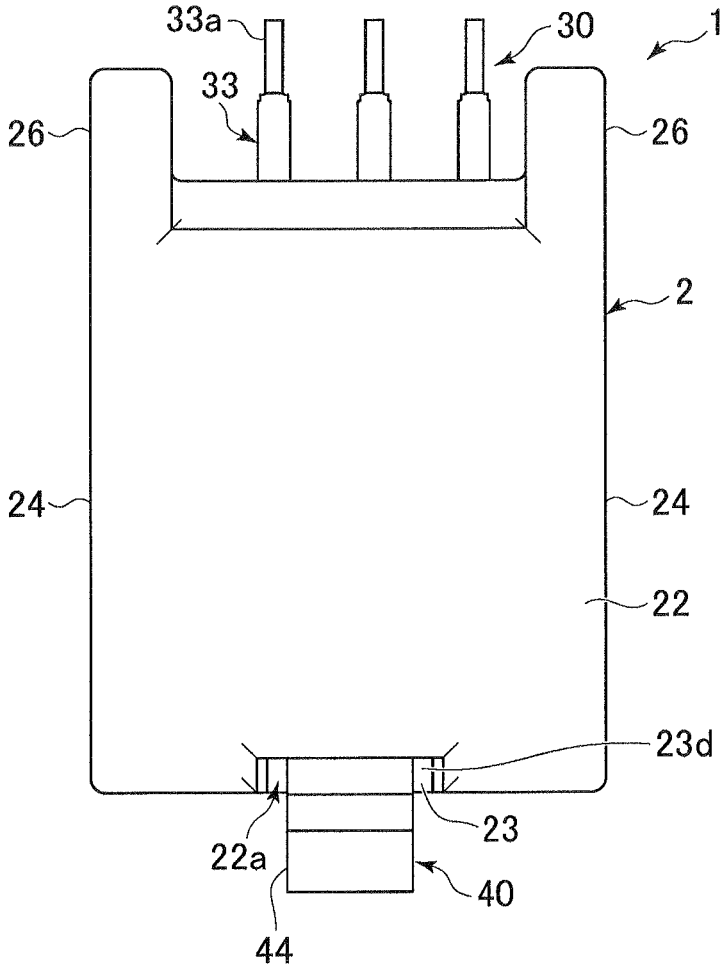
FIG. 3 is a plan view of the electric connector in accordance with the first embodiment of the present invention.
Figure 4:
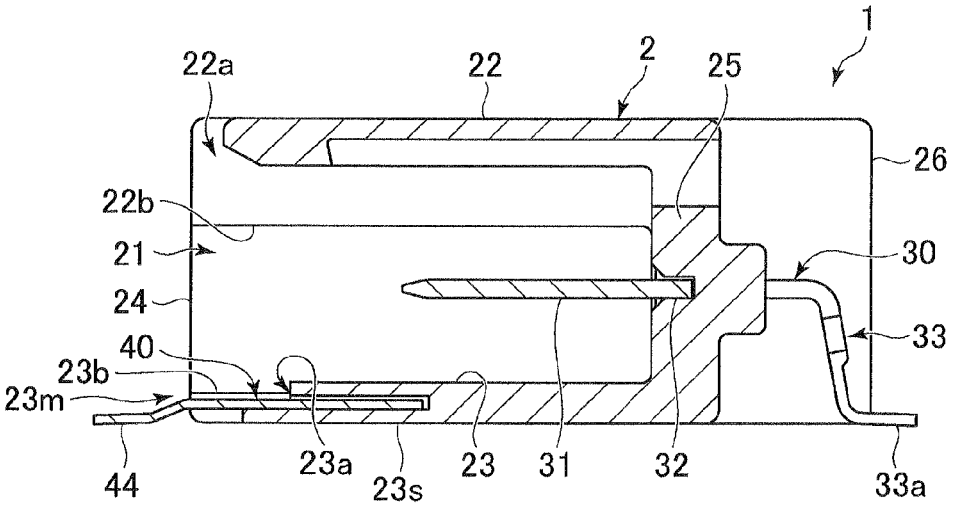
FIG. 4 is a cross-sectional view taken along the line A-A shown in FIG. 2.

As illustrated in FIGS. 1 and 3, the housing 2 includes a pair of vertical walls 26 outwardly extending from the rear walls 26 at opposite edges of the rear walls 26. The vertical walls 26 protect later-mentioned connecting portions of the connector terminals 30, and accordingly, the connecting portions of the connector terminals 30 are located between the vertical walls 26. Furthermore, as illustrated in FIG. 4, when viewed horizontally, the connecting portions of the connector terminals 30 are entirely covered with the vertical walls 26.

The ceiling portion 22 of the housing 2 is formed at an opening edge 22*m* of the inner space 21 with a cut-out 22*a* through which the fixer 40 can be observed from above.

The ceiling portion 22 of the housing 2 is further formed at a lower surface thereof with a pair of linear projections 22*b* adjacent to the cut-out 22*a*. The linear projections 22*b* act as a key for preventing a wrong second electric connector from being inserted into the inner space 21, or preventing a correct second electric connector from being inserted into the inner space 21 upside down.

The floor portion 23 of the housing 2 is formed with a slot 23*a* into which the fixer 40 is inserted. The slot 23*a* is open towards an opening edge 23*m* of the inner space 21. The floor portion 23 is designed to have an area 23A raised relative to or formed higher than other areas of the floor portion 23. The slot 23*a* is formed in the area 23A. As illustrated in FIG. 4, the slot 23*a* starts at a location inwardly away from the opening edge 23*m* of the inner space 21, and the floor portion 23 has a thickness by which the slot 23*a* is not covered therewith. That is, the floor portion 23 is reduced in a thickness in an area 23*d* between the opening edge 23*m* and the slot 23*a*, resulting in that there is formed a stepped portion 23*b* along the area 23*d* having a reduced thickness. The slot 23*a* is open at a height in accordance with a thickness of the area 23*d*.

Figure 2:
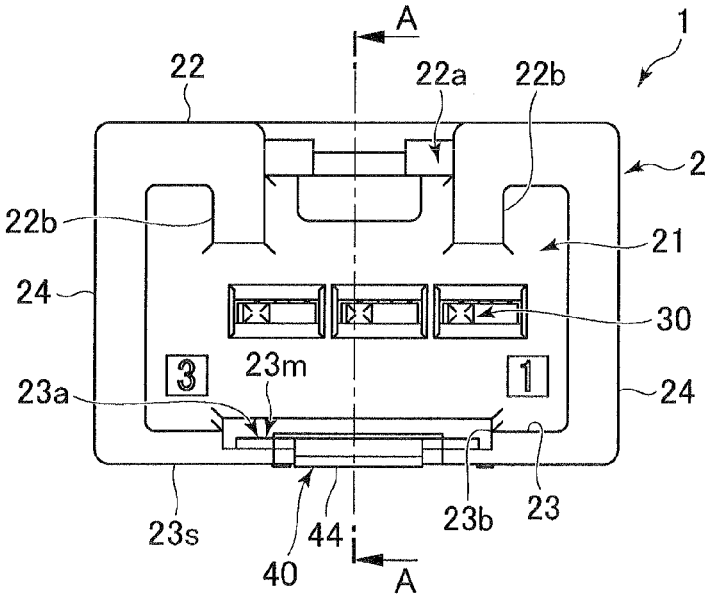
FIG. 2 is a front view of the electric connector in accordance with the first embodiment of the present invention.

As illustrated in FIG. 2, the three connector terminals 30 are horizontally arranged in a line in the inner space 21 of the housing 2. Each of the connector terminals 30 includes a needle pin 31, a body 32, and an external lead 33 to be soldered onto a metal pad P0 formed on the printed circuit board P1.

The needle pin 31 is inserted into a female terminal of a second electric connector to thereby electrically connect with the female terminal. The connector terminal 30 is fixed at the body 32 in a hole formed at the rear wall 25 of the housing 2.

The external lead 33 outwardly extends from the rear wall 25 in a direction opposite to a direction in which the fixer 40 extends. The external lead 33 includes at a distal end thereof a contact portion 33*a* through which the connector terminal 30 is soldered onto the metal pad P0 formed on the printed circuit board as a signal terminal. Before being inserted into the housing 2, the connector terminal 30 is straightly linear. After being inserted into the housing 2, the connector terminal 30 is downwardly bent, and then, horizontally bent to thereby define the crank-shaped external lead 33.

The fixer 40 is soldered to the metal pad P0 formed on the printed circuit board P1, to thereby fix the housing 2 onto the printed circuit board P1.

Figure 5A:
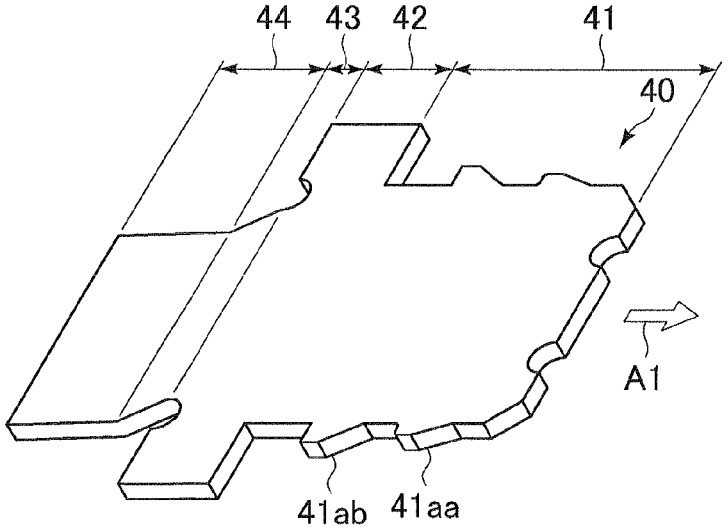
FIG. 5A is a perspective view of the fixer.
Figure 5B:
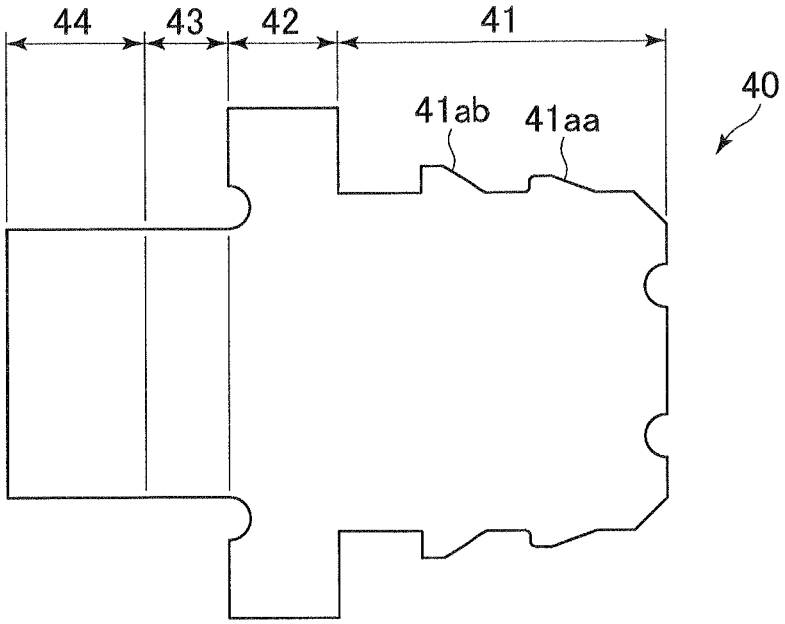
FIG. 5B is a plan view of the fixer.
Figure 5C:
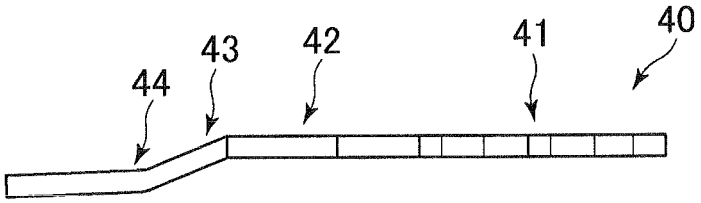
FIG. 5C is a right-side view of the fixer.
Figure 6:
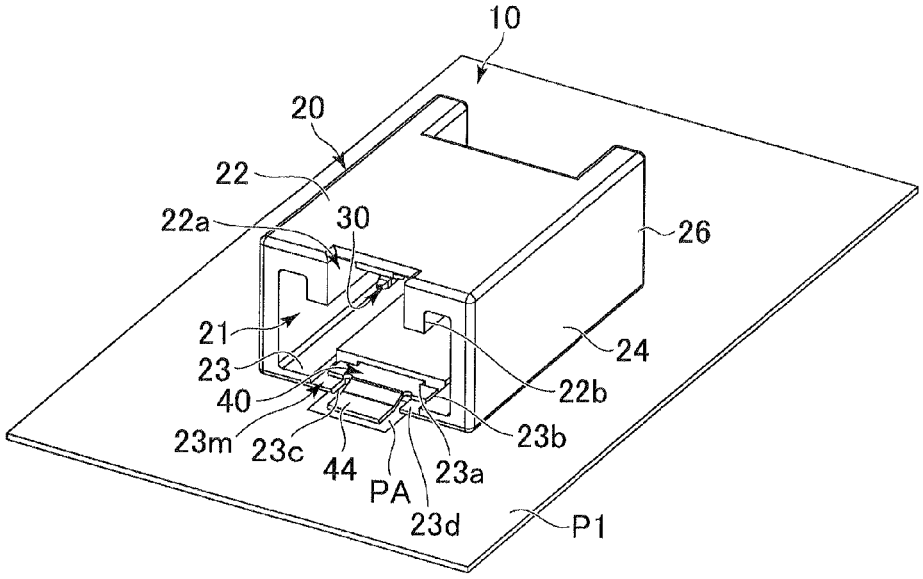
FIG. 6 is a perspective view of the electric connector in accordance with the second embodiment of the present invention.
Figure 7:
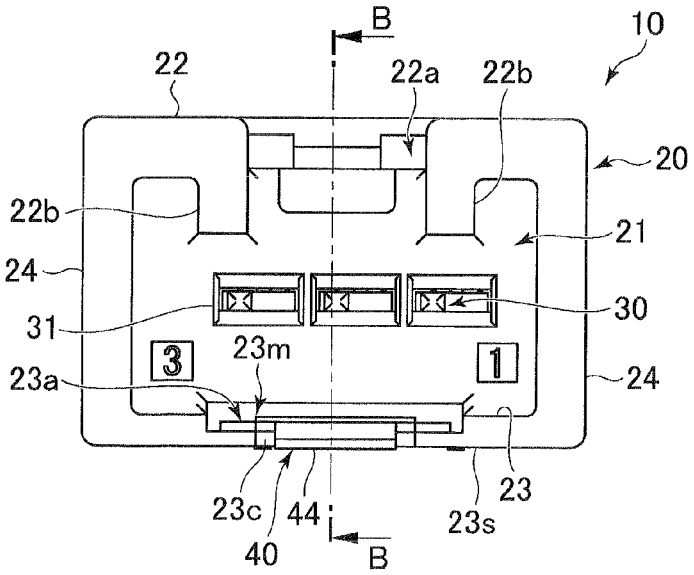
FIG. 7 is a front view of the electric connector in accordance with the second embodiment of the present invention.
Figure 8:
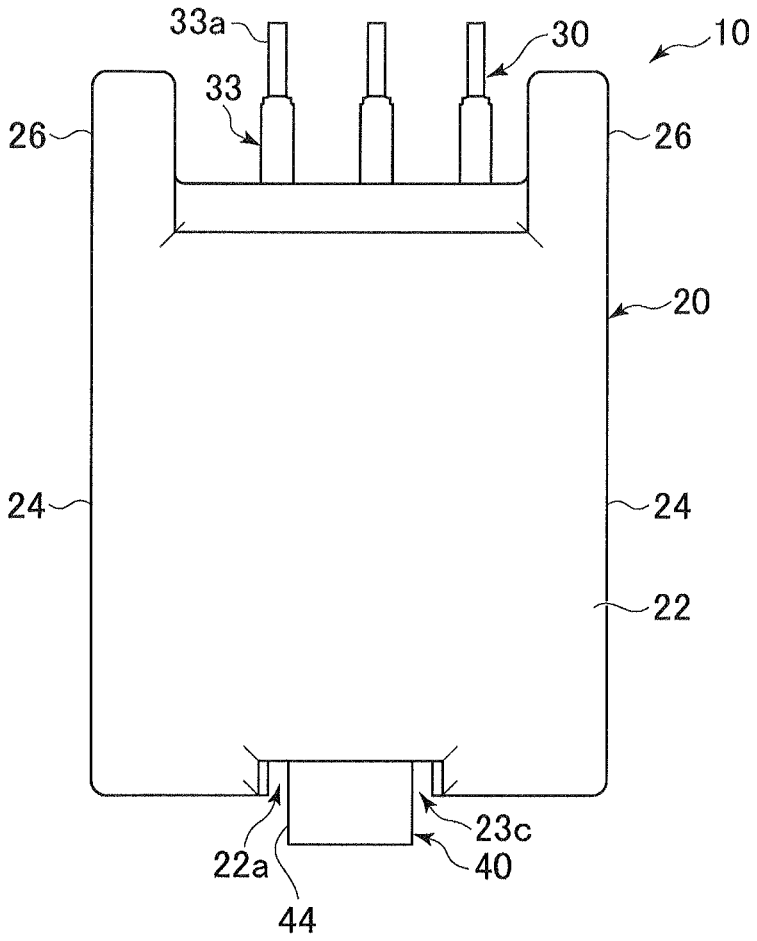
FIG. 8 is a plan view of the electric connector in accordance with the second embodiment of the present invention.
Figure 9:
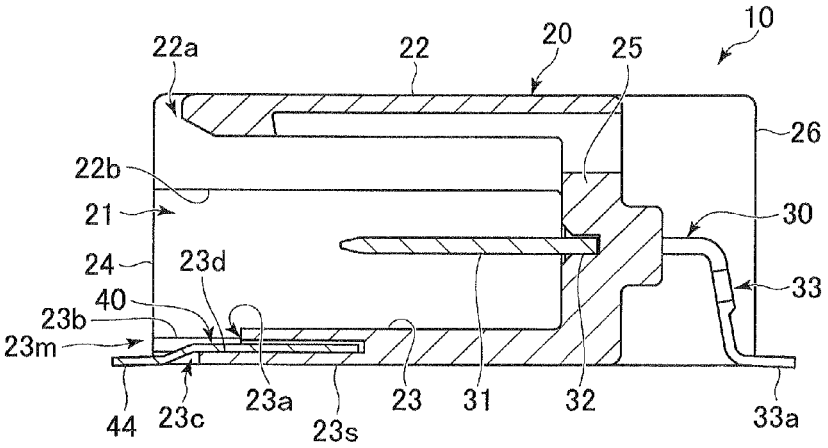
FIG. 9 is a cross-sectional view taken along the line B-B shown in FIG. 7.
Figure 10:
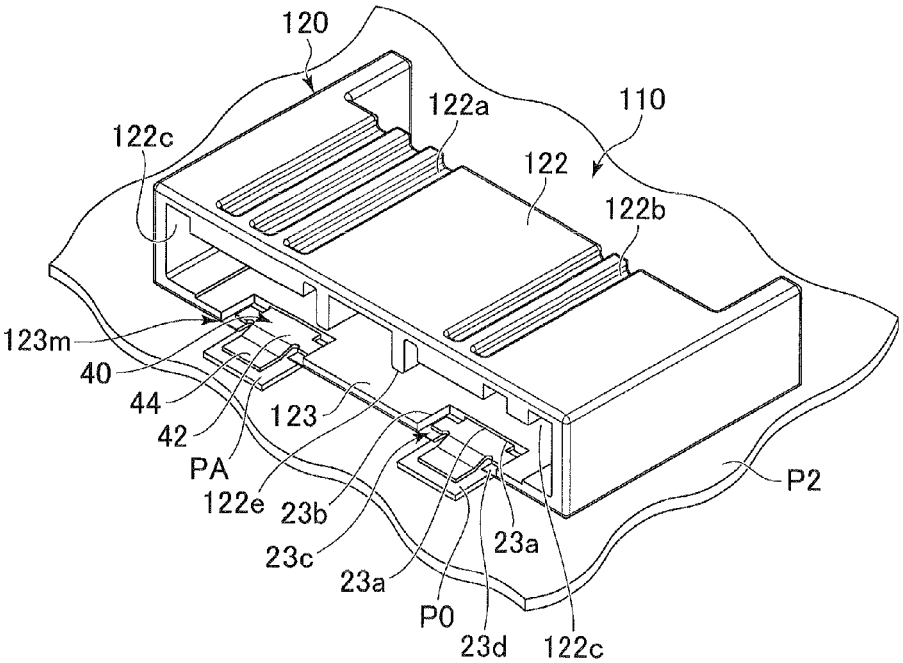
FIG. 10 is a perspective view of the electric connector in accordance with the third embodiment of the present invention.

As illustrated in FIGS. 5A to 5C, the fixer 40 includes a first portion 41 to be inserted into the slot 23*a* and engaged with an inner wall of the slot 23*a*, a second portion 42 being continuous to the first portion 41, and having a width greater than a width of the slot 23*a* for stopping the fixer 40 from being inserted into the slot 23*a* therebeyond, a third portion 43 being continuous to the second portion 42, downwardly inclining relative to the first and second portions 41 and 42, and extending outwardly of the housing 2 when the first portion 41 is inserted into the slot 23*a*, and a fourth portion 44 being continuous to the third portion 43, and making contact at a lower surface thereof with the metal pad P0 formed on the printed circuit board P1.

The fixer 40 is made of a single metal plate.

The first portion 41 includes two trapezoidal projections 41*aa* and 41*ab* outwardly projecting from each of opposite edges of the first portion 41. The projection 41*aa* located ahead of the projection 41*ab* in a direction A1 in which the fixer 40 is inserted into the slot 23*a* is designed to have a longer oblique side than the same of the projection 41*ab*. The projections 41*aa* and 41*ab* are engaged with an inner wall of the slot 23*a* when the fixer 40 is inserted into the slot 23*a*.

The second portion 42 outwardly extends beyond the first portion 41 to thereby have a width greater than a width of the slot 23*a*, ensuring that the fixer 40 stops at the second portion 42 when the fixer 40 is inserted into the slot 23*a*.

The third portion 43 downwardly inclines relative to the first and second portions 41 and 42 between the second portion 42 and the fourth portion 44.

As illustrated in FIG. 5C, the fourth portion 44 is extensive in parallel with the first and second portions 41 and 42. The fourth portion 44 is soldered onto the metal pad P0 to thereby fix the fixer 40 to the printed circuit board P1.

As explained so far, the electric connector 1 in accordance with the first embodiment is mounted on the printed circuit board P1 with the lower surface 23*s* of the floor portion 23 lying on the printed circuit board P1, and the fixer 40 inserted into the slot 23*a* extends outwardly of the housing 2. Thus, the fixer 40 is not located beneath the housing 2, avoiding the housing 2 from having an increased height. Thus, the electric connector 1 in accordance with the first embodiment is able to maintain a high density with which electric connectors are mounted on the printed circuit board P1, and avoid the housing 2 from being tall.

Since the fixer 40 extends only forwardly of the housing 2, there are spaces adjacent to the sidewalls 24 of the housing 2. Accordingly, other electric parts can be mounted on the printed circuit board P1 in contiguity with the electric connector 1. An area extensive in front of the housing 2 is necessary as a space in which a second electric connector is inserted into and pulled out of the housing 2, and accordingly, other electric parts are not allowed to mount in this area regardless of whether the electric connector 1 includes the fixer 40.

Accordingly, an area in which the fixer 40 is soldered onto the metal pad P0 does not increase an area to be occupied by the electric connector 1 on the printed circuit board P1.

Furthermore, even if a second electric connector were attempted to be lifted up when the second electric connector is inserted into and pulled out of the inner space 21 of the housing 2, the housing 2 is firmly fixed at the floor portion 23 thereof to the printed circuit board P1 by means of the fixer 40, and accordingly, it is possible to avoid the housing 2 from being lifted up.

The third portion 43 is bent to thereby downwardly incline relative to the first and second portions 41 and 42 in the fixer 40 in the first embodiment. As an alternative, the third portion 43 may be bent perpendicularly to the first and second portions 41 and 42, and then, bent again perpendicularly to thereby define the fourth portion 44, in which case, the third and fourth portions 43 and 44 are in the form of a crank.

Since the third portion 43 downwardly inclines between the first/second portions 41/42 and the fourth portion 44, the fourth portion 44 can be resilient relative to the first/second portions 41/42. Accordingly, when the fourth portion 44 is bent relative to the first and second portions 41 and 42 in accordance with a height from the printed circuit board P1 to the floor portion 23, even if the fourth portion 44 were bent by inaccurate degrees, the fixer 40 can be resiliently deformed at the third portion 43 to thereby be able to be mounted on the printed circuit board P1. That is, the third portion 43 can absorb an angular gap between a designed angle and an inaccurate angle by which the fourth portion 44 is bent.

Since the slot 23*a* is open above the area 23*d* of the floor portion 23, the slot 23*a* can be located lower than the case that the floor portion 23 does not include the area 23*d*, and hence, is uniform in a thickness. This ensures that the fixer 40 can reach the printed circuit board P1 at a shorter distance than the above-mentioned case.

As illustrated in FIG. 4, the connector terminal 30 extends outwardly of the housing 2 to define the contact portion 33*a* through which the external lead 33 is soldered onto the metal pad P0 acting as a signal terminal for the printed circuit board P1. Thus, since the fixer 40 prevents the housing 2 from being lifted up at the opening edge 23*m*, it is possible to prevent the external lead 33 from being loaded excessively, and further prevent the contact portion 33*a* from being released from the metal pad P0.

Since the fourth portion 44 through which the fixer 40 is soldered onto the metal pad P0 extends beyond the opening edge 23*m* of the inner space 21, the connection between the fourth portion 44 and the metal pad P0 can be readily observed in an image test for inspecting the condition of the connection between the fixer 40 (and accordingly, the housing 2) and the printed circuit board P1.

The fixer 40 can be attached to the housing 2 by carrying out the simple action, that is, inserting the fixer 40 into the slot 23*a* to thereby cause the first portion 41 to be engaged with an inner wall of the slot 23*a*. Furthermore, the fixer 40 can be fixed onto the printed circuit board P1 merely by soldering the fourth portion 44 extending from the slot 23*a*, onto the metal pad P0.

Since the slot 23*a* is formed in the area 23A formed higher than the surrounding area, the area 23A can work as a key for preventing a wrong second electric connector from being inserted into the inner space 21, or preventing a correct second electric connector from being inserted into the inner space 21 upside down.

The housing 2 is formed at the ceiling portion 22 thereof with the cut-out 22*a* starting from the opening edge 23*m*. Thus, the connection between the fourth portion 44 of the fixer 40 and the metal pad P0 can be observed through the cut-out 22*a* from above.

As an alternative a through-hole or through-holes may be formed in place of the cut-out 22*a*.

Second Embodiment

The electric connector in accordance with the second embodiment of the present invention is explained hereinbelow with reference to FIGS. 6 to 9. Parts or elements that correspond to those of the first embodiment illustrated in FIGS. 1 to 4 have been provided with the same reference numerals, and operate in the same manner as corresponding parts or elements in the first embodiment, unless explicitly explained hereinbelow.

The electric connector in accordance with the second embodiment is structurally different from the electric connector in accordance with the first embodiment in that the floor portion 23 is formed with a cut-out 23*c*.

Specifically, as illustrated in FIGS. 6 to 9, the floor portion 23 is formed with the cut-out 23*c* starting from the opening edge 23*m* and terminating at the slot 23*a* at the longest such that the cut-out 23*c* does not interfere with the third and fourth portions 43 and 44, and the floor portion 23.

If the floor portion 23 is not formed with the cut-out 23*c*, the third portion 43 has to be bent at the opening edge 23*m* towards the printed circuit board P1. Accordingly, the third and fourth portions 43 and 44 are necessary to be designed to be long enough to allow the fourth portion 44 to have a sufficient area through which the fourth portion 44 is soldered onto the metal pad P0.

However, the floor portion 23 of a housing 20 in the second embodiment is formed with the cut-out 23*c* starting from the opening edge 23*m*. Thus, the third portion 43 is allowed to be bent at a location away from the opening edge 23*m* inwardly of the inner space 21, ensuring that the third and fourth portions 43 and 44 may be shorter in length than the above-mentioned case where the floor portion 23 is not formed with the cut-out 23*c*. Furthermore, since the third and fourth portions 43 and 44 extend towards the printed circuit board P1, and thus, the fourth portion 44 is not located beneath the housing 20, the housing 20 can avoid from having an increased height. Thus, the electric connector 10 in accordance with the second embodiment ensures a high density with which electric parts are mounted on the printed circuit board P1, and avoids from being tall.

In addition, since the third portion 43 downwardly inclining relative to the first and second portions 41 and 42 passes through the cut-out 23*c*, the fourth portion 44 is able to have a sufficient area through which the fourth portion 44 is soldered onto the metal pad P0, even if the third portion 43 is designed to be short.

Similarly to the first embodiment, since the third portion 43 downwardly inclines between the first/second portions 41/42 and the fourth portion 44, the fourth portion 44 can be resilient relative to the first/second portions 41/42. Accordingly, when the fourth portion 44 is bent relative to the first and second portions 41 and 42 in accordance with a height from the printed circuit board P1 to the floor portion 23, even if the fourth portion 44 were bent by inaccurate degrees, the fixer 40 can be resiliently deformed at the third portion 43 to thereby be able to be mounted on the printed circuit board P1. That is, the third portion 43 can absorb an angular gap between a designed angle and an inaccurate angle by which the fourth portion 44 is bent.

Third Embodiment

The electric connector in accordance with the third embodiment of the present invention is explained hereinbelow with reference to FIGS. 10 to 13. Parts or elements that correspond to those of the first and second embodiments illustrated in FIGS. 1 to 4 and FIGS. 6 to 9, respectively, have been provided with the same reference numerals, and operate in the same manner as corresponding parts or elements in the first embodiment, unless explicitly explained hereinbelow.

Whereas the electric connectors 10 in accordance with the first and second embodiments are designed to singly include the fixer 40, the electric connector 110 in accordance with the third embodiment is designed to include a plurality of the fixers 40.

As illustrated in FIGS. 10 to 13, the electric connector 110 includes a housing 120, and first and second sets 130*a* and 130*b* of connector terminals 30, each set including four connector terminals 30. Each of the connector terminals 30 includes a needle pin 31 extending inwardly of the inner space 121 from a rear wall 125 of the housing 120.

The housing 120 is designed to have a width longer than the same of the housings 2 and 20 (see FIGS. 1 and 6) in accordance with an increase in the number of the connector terminals 30.

The ceiling portion 122 of the housing 120 is formed at an outer surface thereof with three linear recesses 122*a* in association with the first set 130*a* of the connector terminals 30, and further with two linear recesses 122*b* in association with the second set 130*b* of the connector terminals 30. The recesses 122*a* and 122*b* extend in parallel with the connector terminals 30. In a product fabricated by resin molding, such as the housing 120, molten resin is contracted during molding, and thus, recesses may be formed at a surface of a final product. The molten resin is contracted to a greater degree, and further, the recesses are generated at a higher frequency in a product containing a greater amount of resin. It is possible to avoid generation of the recesses by forming the ceiling portion 122 of the housing 120 at an outer surface thereof with the linear recesses 122*a* and 122*b*. Furthermore, the linear recesses 122*a* and 122*b* provide the housing 120 a resistance against bending in a front-rear direction of the housing 120.

Figure 11:
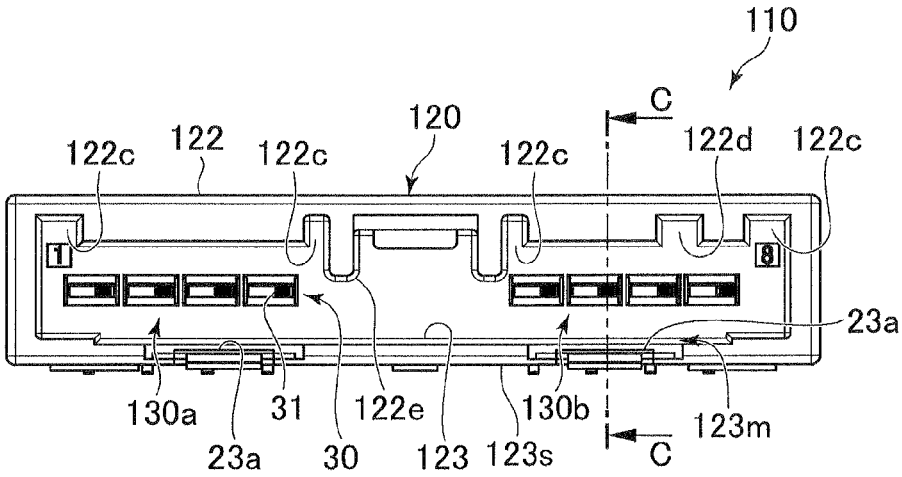
FIG. 11 is a front view of the electric connector in accordance with the third embodiment of the present invention.
Figure 12:
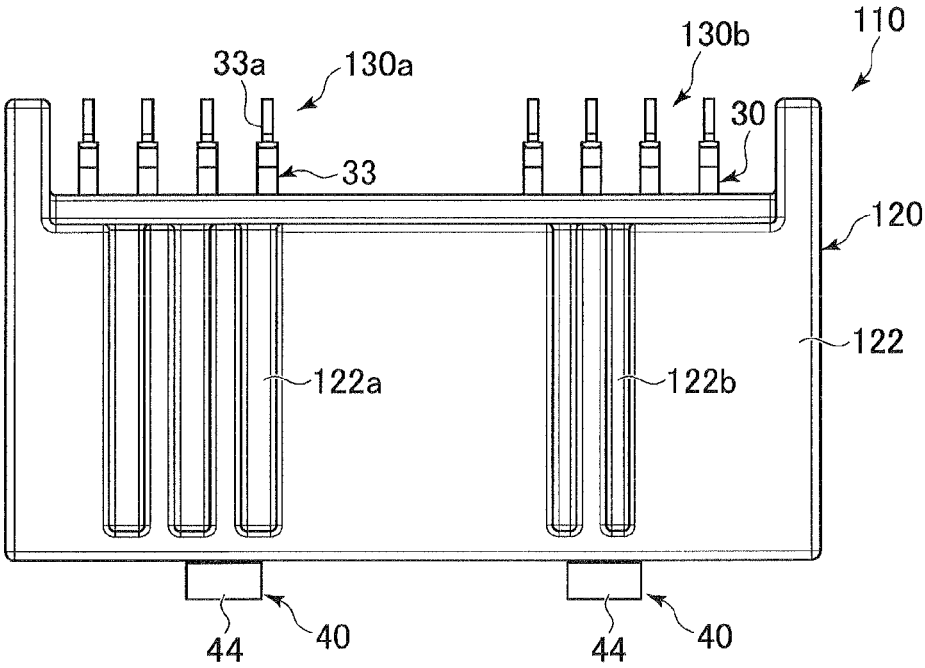
FIG. 12 is a plan view of the electric connector in accordance with the third embodiment of the present invention.
Figure 13:
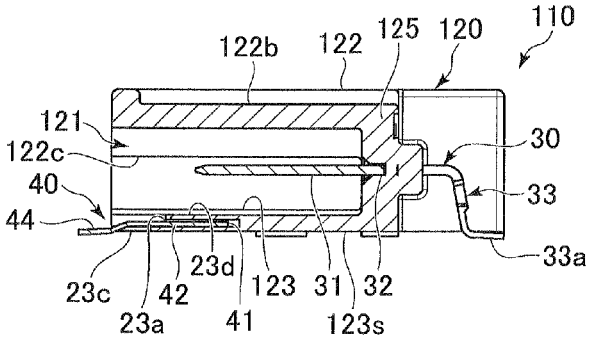
FIG. 13 is a cross-sectional view taken along the line C-C shown in FIG. 11.
Figure 14:
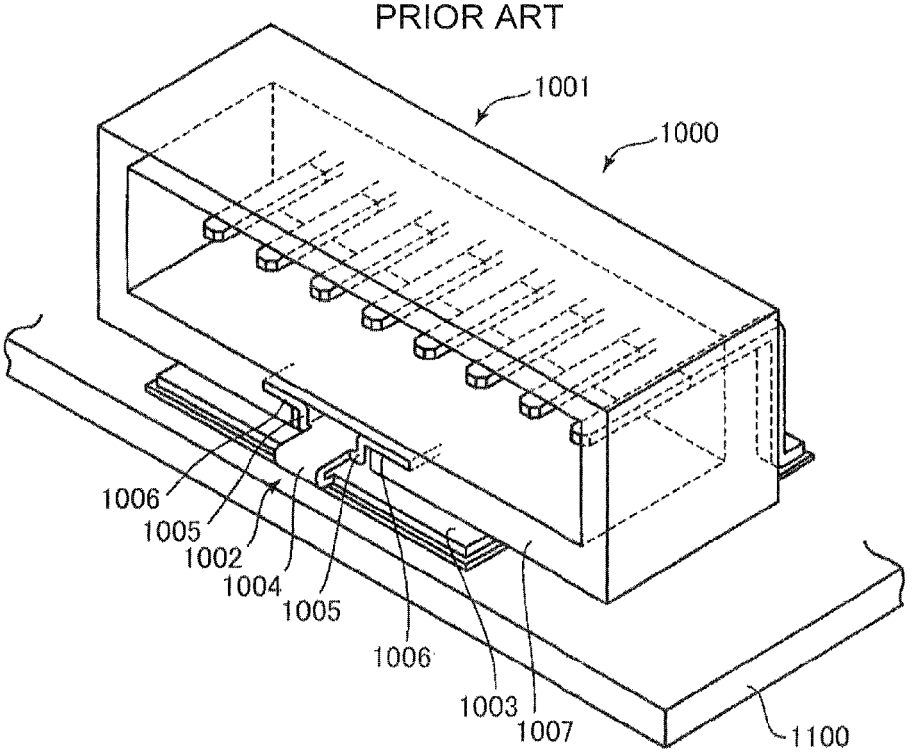
FIG. 14 PRIOR ART
FIG. 14 is a perspective view of the conventional electric connector.
Figure 15:
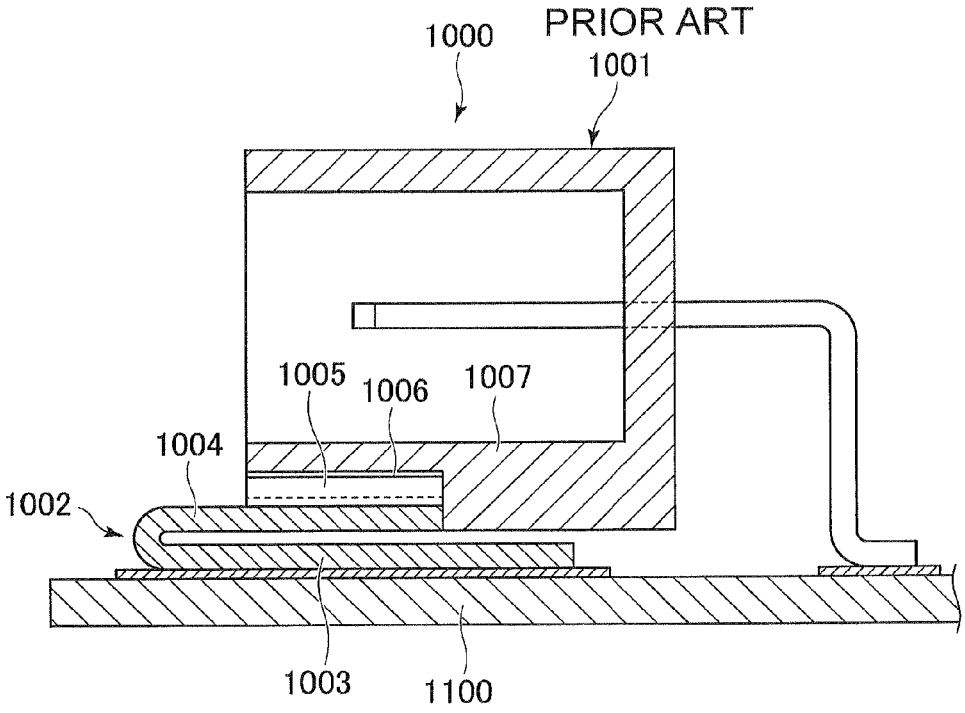
FIG. 15 PRIOR ART
FIG. 15 is a cross-sectional view of the electric connector illustrated in FIG. 14.

As illustrated in FIG. 11, the ceiling portion 122 of the housing 120 is formed at an inner surface thereof with liner recesses 122*c* in alignment with opposite ends of the first and second sets 130*a* and 130*b* of the connector terminals 30, and further with a liner recess 122*d* in association with the second set 130*b* of the connector terminals 30.

The ceiling portion 122 is formed at an inner surface thereof with a pair of liner projections 122*e* by which the first set 130*a* of the connector terminals 30 and the second set 130*b* of the connector terminals 30 are separated from each other.

A floor portion 123 of the housing 120 is formed with two slots 23*a* in alignment with the first and second sets 130*a* and 130*b* of the connector terminals 30. The fixer 40 is inserted into each of the slots 23*a*.

Even though the housing 120 has a width greater than the same of the housings 2 and 20 in the first and second embodiments, respectively, since the electric connector 110 in accordance with the third embodiment is designed to include a plurality of the fixers 40, the housing 120 can be firmly fixed on a printed circuit board P2, ensuring that it is possible to avoid the housing 120 from being lifted up. Thus, it is possible to prevent the external lead 33 from being loaded excessively, and further prevent the contact portion 33*a* from being released from the metal pad P0.

Since the electric connector 110 includes a plurality of the slots 23*a* and the fixers 40 in the same number of the slots 23*a* in accordance with a number of sets of the connector terminals 30, it is possible to enhance a resistance of the contact portions 33*a* of the connector terminals 30 against being peeling off the printed circuit board P2.

The electric connector 110 in accordance with the third embodiment is designed to include the two sets 130*a* and 130*b* of the connector terminals 30 and accordingly the two fixers 40. It should be noted that the electric connector 110 may be designed to include three or more sets of the connector terminals 30 and the fixers 40 in the same number of sets of the connector terminals 30. Furthermore, the connector terminals 30 may be equally spaced away from one another, and/or may be arranged vertically in a plurality of rows.

In addition, the ceiling portion 122 may be formed with the above-mentioned cut-out 22*a* and/or through-hole(s) through which the fixer 40 can be observed from above, similarly to the electric connector 10 in accordance with the first embodiment. The housing 120 may be formed at the floor portion 123 with the above-mentioned area 23A, similarly to the first embodiment.

INDUSTRIAL APPLICABILITY

The electric connector in accordance with the present invention can be broadly employed in various fields such as an electric/electronic industry and an automobile industry, as an electric connector to be equipped in various electric/electronic devices or in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-239192 filed on Nov. 19, 2013 including specification, claims, drawings and summary is incorporated herein by reference in its entirety.

What is claimed is:

1. An electric connector to be mounted on a printed circuit board, including:

a housing having an inner space into which a second electric connector is inserted in a direction in which a plane of said printed circuit board is extensive; and at least one fixer through which said housing is fixed on said printed circuit board, said fixer including an extending portion extending from a floor portion of said housing towards outside of said housing, and making contact at a lower surface thereof with a surface of said printed circuit board, said extending portion being fixed at the lower surface thereof on said surface of said printed circuit board to cause said electric connector to be fixed on said surface of said printed circuit board, said floor portion being formed with a slot being open towards an opening edge of said inner space, said fixer being inserted into said slot to thereby be held relative to said housing, said fixer being situated across said opening edge, said extending portion having a distal end extending beyond said opening edge towards outside of said housing in a direction opposite to said inserted direction of said second electric connector.

2. The electric connector as set forth in claim 1, wherein said floor portion is raised in a particular area than other area, said particular area including an area in which said slot is formed.

3. The electric connector as set forth in claim 1, wherein said slot is located away from said opening edge, said floor portion having a thickness by which said slot is not covered therewith in an area between said opening edge and said slot.

4. The electric connector as set forth in claim 1, wherein said floor portion is formed with a cut-out starting from said opening edge and terminating at said slot at a long edge thereof the longest, said extending portion extending towards outside of said housing through said cut-out.

5. The electric connector as set forth in claim 1, wherein said extending portion has a portion downwardly inclining from said floor portion to said printed circuit board.

6. The electric connector as set forth in claim 1, wherein said housing is formed at a ceiling portion thereof with at least one of cut-out and a through-hole starting from said opening edge.

7. A fixer through which an electric connector is fixed on a printed circuit board, said electric connector including a housing having an inner space into which a second electric connector is inserted in a direction in which a plane of said printed circuit board is extensive, said housing is formed at a floor portion thereof with a slot being open towards an opening edge of said inner space, said fixer including:

a first portion to be inserted into said slot and engaged with said slot;

a second portion being continuous to said first portion, and having a width greater than a width of said slot for stopping said fixer from being inserted into said slot therebeyond;

a third portion being continuous to said second portion, downwardly inclining relative to said first portion, and extending outwardly of said housing when said first portion is inserted into said slot; and a fourth portion being continuous to said third portion, and making contact at a lower surface thereof with a surface of said printed circuit board.

8. The fixer as set forth in claim 7, wherein said fixer is made of a single metal plate.

9. An electric connector to be mounted on a printed circuit board, including:

a housing having an inner space into which a second electric connector is inserted in a direction in which a plane of said printed circuit board is extensive; and at least one fixer through which said housing is fixed on said printed circuit board, said fixer including an extending portion extending from a floor portion of said housing towards outside of said housing, and making contact at a lower surface thereof with a surface of said printed circuit board, said extending portion being fixed at the lower surface thereof on said surface of said printed circuit board to cause said electric connector to be fixed on said surface of said printed circuit board, wherein said housing is formed at a ceiling portion thereof with at least one of cut-out and a through-hole starting from said opening edge.

10. The electric connector as set forth in claim 9, wherein said floor portion is formed with a slot being open towards an opening edge of said inner space, said fixer being inserted into said slot to thereby be held relative to said housing.

11. The electric connector as set forth in claim 9, wherein said floor portion is raised in a particular area than other area, said particular area including an area in which said slot is formed.

12. The electric connector as set forth in claim 9, wherein said slot is located away from said opening edge, said floor portion having a thickness by which said slot is not covered therewith in an area between said opening edge and said slot.

13. The electric connector as set forth in claim 9, wherein said floor portion is formed with a cut-out starting from said opening edge and terminating at said slot at a long edge thereof, said extending portion extending towards outside of said housing through said cut-out.

14. The electric connector as set forth in claim 9, wherein said extending portion has a portion downwardly inclining from said floor portion to said printed circuit board.

* * * * *